US009574729B2

(12) United States Patent
Quadri et al.

(10) Patent No.: US 9,574,729 B2
(45) Date of Patent: Feb. 21, 2017

(54) STAGE LIGHT FIXTURE FOR VARYING THE LIGHT BEAM CONCENTRATION UNIFORMITY AND METHOD FOR OPERATING SAID STAGE LIGHT FIXTURE

(71) Applicant: CLAY PAKY S.p.A., Seriate (IT)

(72) Inventors: Pasquale Quadri, Torre de'Roveri (IT); Angelo Cavenati, Brusaporto (IT)

(73) Assignee: CLAY PAKY S.P.A., Seriate (IT)

( * ) Notice: Subject to any disclaimer, the term of this patent is extended or adjusted under 35 U.S.C. 154(b) by 335 days.

(21) Appl. No.: 13/919,342

(22) Filed: Jun. 17, 2013

(65) Prior Publication Data

US 2013/0343057 A1 Dec. 26, 2013

(30) Foreign Application Priority Data

Jun. 18, 2012 (IT) ..... MI2012A001060

(51) Int. Cl.

| | |
|---|---|
| ***F21S 10/00*** | (2006.01) |
| ***F21V 11/10*** | (2006.01) |
| ***F21V 7/00*** | (2006.01) |
| ***F21V 13/04*** | (2006.01) |
| *F21W 131/406* | (2006.01) |
| *F21V 5/00* | (2015.01) |
| *F21V 5/04* | (2006.01) |

(52) U.S. Cl.

CPC ..... *F21S 10/00* (2013.01); *F21V 7/00* (2013.01); *F21V 11/10* (2013.01); *F21V 13/04* (2013.01); *F21V 5/008* (2013.01); *F21V 5/048* (2013.01); *F21W 2131/406* (2013.01)

(58) Field of Classification Search

CPC ..... F21V 5/04; F21V 10/046; F21V 11/10; F21V 13/04; F21V 5/008; F21S 10/026; F21S 10/007; F21S 10/046

USPC ..... 362/268, 270

See application file for complete search history.

(56) References Cited

U.S. PATENT DOCUMENTS

| | | | | |
|---|---|---|---|---|
| 6,282,027 | B1 * | 8/2001 | Hough | G02B 27/0961 359/618 |
| 7,226,188 | B2 * | 6/2007 | Hough | 362/268 |
| 2003/0072161 | A1 * | 4/2003 | Hough | F21V 5/008 362/293 |
| 2011/0063847 | A1 | 3/2011 | Quadri et al. | |
| 2011/0267704 | A1 * | 11/2011 | Sado | G02B 15/177 359/680 |
| 2011/0304921 | A1 * | 12/2011 | Nagahara | G02B 15/177 359/680 |

FOREIGN PATENT DOCUMENTS

| | | |
|---|---|---|
| CN | 1432117 | 7/2003 |
| EP | 1001210 | 5/2000 |
| WO | WO 96/36834 | 11/1996 |

* cited by examiner

*Primary Examiner* — Karabi Guharay
(74) *Attorney, Agent, or Firm* — Leason Ellis LLP

(57) ABSTRACT

A stage light fixture is provided with a light source adapted to emit a light beam along an optical axis; a reflector coupled to the light source; a diaphragm arranged along the optical axis downstream of the light source; a first optical assembly, which is arranged along the optical axis between the light source and the diaphragm and is configured to selectively change the light beam dimensions.

18 Claims, 3 Drawing Sheets

STAGE LIGHT FIXTURE FOR VARYING THE LIGHT BEAM CONCENTRATION UNIFORMITY AND METHOD FOR OPERATING SAID STAGE LIGHT FIXTURE

The present invention relates to a stage light fixture and to a method for operating said stage light fixture.

BACKGROUND OF THE INVENTION

Stage light fixtures are known, which are provided with a light source adapted to emit a light beam along an optical axis and with at least one diaphragm arranged along the optical axis for intercepting the light beam. The stage light fixtures of this type are also generally provided with a zoom assembly arranged downstream of the diaphragm along the optical axis. Therefore, in the stage light fixtures of this type, the zoom assembly is arranged so as to intercept the beam after the beam has crossed the diaphragm and is configured to enlarge or reduce the dimensions of the projected beam.

However, the stage light fixtures of this type emit a light beam characterized by a luminosity which decreases as the distance at which the beam is to be projected increases. In such stage light fixtures, the luminosity cannot be changed and thus, preventing the loss of luminosity is not possible.

SUMMARY OF THE INVENTION

Therefore, it is an object of the present invention to provide a stage light fixture which is free from the above-mentioned drawbacks of the prior art; in particular, it is an object of the invention to provide a stage light fixture capable of increasing the luminosity of the light beam while maintaining a high quality of the beam and being easy and cost-effective to be implemented.

According to such objects, the present invention relates to a stage light fixture comprising:

a light source adapted to emit a light beam along an optical axis;

a reflector coupled to the light source;

a diaphragm arranged along the optical axis downstream of the light source;

a first optical assembly, which is arranged along the optical axis between the light source and the diaphragm and is configured to selectively change the light beam dimensions.

Thereby, the light beam is processed by the first optical assembly before crossing the diaphragm. In particular, the first optical assembly enlarges or concentrates the light beam which hits the diaphragm. Due to the presence of the first optical assembly, the beam luminosity and the beam quality are also optimized at long projecting distances.

The first optical assembly is capable of determining an increase in the beam luminosity and/or quality according to the stage needs. For example, if the beam must be projected at a long distance, the first optical assembly may be regulated so that the beam emitted is characterized by a high luminosity, whereas if the beam must be projected relatively close to the stage light fixture, the first optical assembly may be regulated so that the beam emitted by the stage light fixture is characterized by a high quality.

Therefore, due to the arrangement of the first optical assembly between the light source and the diaphragm, the stage light fixture according to the present invention is capable of emitting a light beam of excellent quality and also having a suitable intensity at long projecting distances.

According to a preferred embodiment of the stage light fixture according to the present invention, the first optical assembly comprises at least a first optical device and at least a second optical device, arranged downstream of the first optical device. Thereby, the first optical assembly is implemented in a simple and cost-effective manner.

According to a preferred embodiment of the stage light fixture according to the present invention, the light source and the reflector are configured and coupled together so as to emit a light beam substantially focused in the environs of a working point of light beam; the first optical device being arranged at said working point.

In this way, the first optical device of the first optical assembly captures the concentrated portion of the light beam.

According to a preferred embodiment of the stage light fixture according to the present invention, the first optical device is immobile and the second optical device is mobile along the optical axis. Thereby, the size change of the light beam is obtained in a simple and effective manner by displacing the second optical device along the optical axis.

According to a preferred embodiment of the stage light fixture according to the present invention, the stage light fixture comprises a second optical assembly, which is arranged downstream of the diaphragm along the optical axis and has a focal point; the diaphragm being arranged at the focal point. Thereby, the light beam projected is focused.

It is a further object of the present invention to provide a method for operating a stage light fixture which allows, in a simple and effective manner, to modify the luminosity of the light beam while maintaining a high quality of the beam.

In accordance with such objects, the present invention relates to a method for operating a stage light fixture; the stage light fixture comprising a light source adapted to emit a light beam along an optical axis; a reflector coupled to the light source; a diaphragm arranged along the optical axis downstream of the light source; and a first optical assembly, which is arranged along the optical axis between the light source and the diaphragm and is configured to selectively change the light beam dimensions; the method comprising the step of regulating the first optical assembly so as to modify the dimensions of the light beam which hits the diaphragm according to the stage needs.

Due to the regulation of the first optical assembly a variation in the luminosity of the light beam can be obtained. Thereby, the loss of luminosity which occurs as the projecting distance of the light beam increases may be compensated.

BRIEF DESCRIPTION OF THE DRAWINGS

Further features and advantages of the present invention will become apparent from the following description of a non-limiting embodiment thereof, made with reference to the figures in the accompanying drawings, in which.

DETAILED DESCRIPTION OF THE INVENTION

Figure 1:
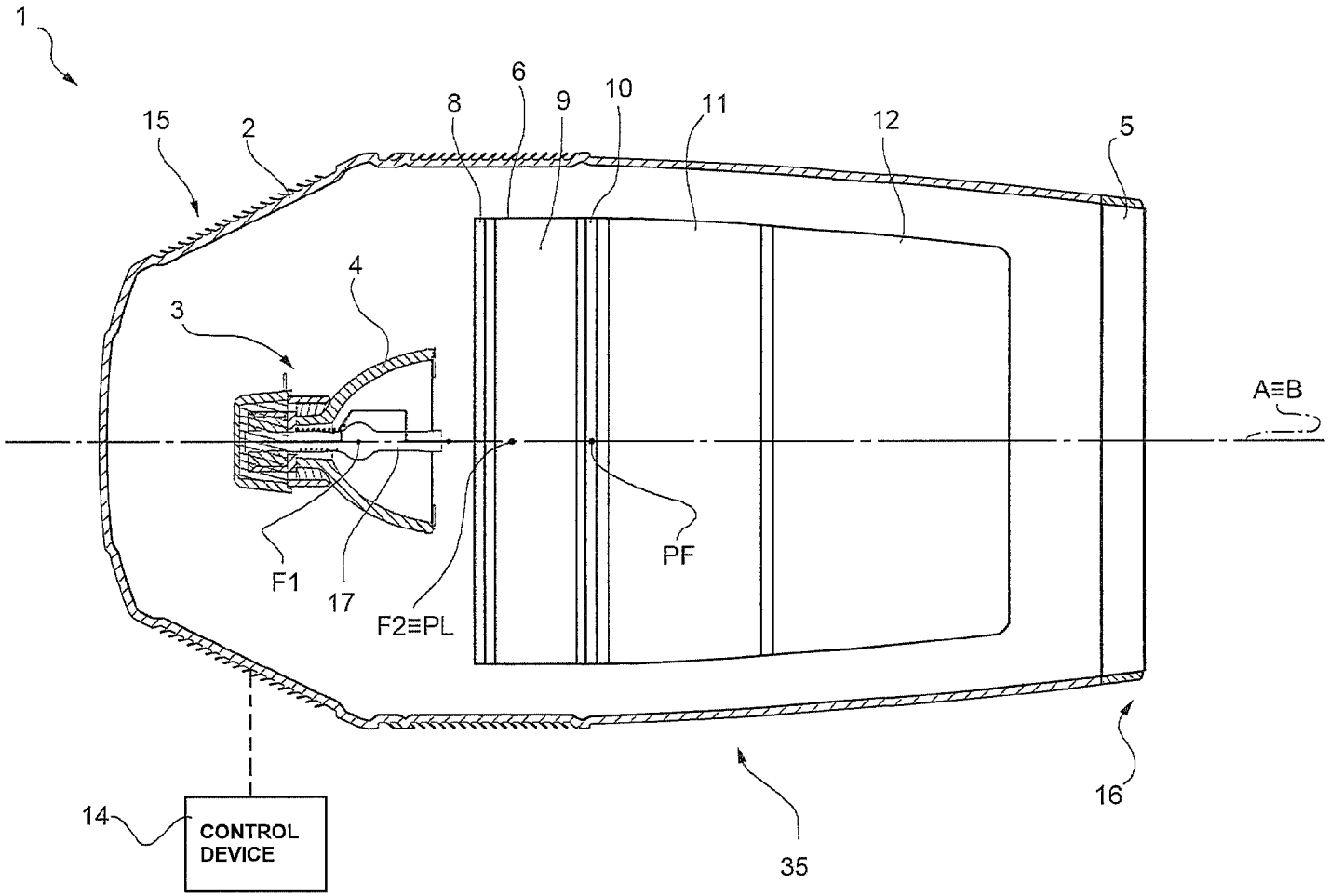
FIG. 1 shows a diagrammatic view, with parts in section and parts removed for clarity, of a stage light fixture according to the present invention.

In FIG. 1, reference numeral 1 indicates a diagrammatically shown stage light fixture. The stage light fixture 1 comprises a casing 2, a light source 3, a reflector 4, an objective lens 5, a framework 6 coupled to casing 2, a heat-shield assembly 8, a first optical assembly 9, a diaphragm 10, beam processing means 11, a zoom assembly 12 and a control device 14.

Casing 2 extends along a longitudinal axis A and has a closed end 15 and an open end 16 opposite to the closed end 15 along axis A. Casing 2 is preferably supported by supporting means (not shown for simplicity in the accompanying figures). In particular, the supporting means and the casing 2 are configured to allow casing 2 to rotate about two orthogonal axes, commonly referred to as PAN and TILT axes.

Framework 6 (not entirely visible in FIG. 1) consists of elements coupled together so as to define a supporting structure, which supports elements arranged inside casing 2 such as the light source 3, the reflector 4, the heat-shield assembly 8, the first optical assembly 9, the diaphragm 10, the light beam processing means 11 and the zoom assembly 12.

The light source 3 is arranged inside casing 2 at the closed end 15 of casing 2, is supported by framework and is adapted to emit a light beam substantially along an optical axis B.

In the non-limiting example described and shown herein, the optical axis B coincides with the longitudinal axis A of casing 2.

The heat-shield assembly 8, the first optical assembly 9, diaphragm 10, the beam processing means 11 and the zoom assembly 12 are preferably arranged in a sequence along the optical axis B to selectively intercept the light beam emitted by the light source 3.

Reflector 4 and light source 3 are configured and coupled together so as to emit a very intense light beam substantially focused in the environs of a point, commonly referred to as working point PL of the light beam.

In the non-limiting example described and shown herein, light source 3 is a discharge lamp comprising a bulb 17, generally made of glass or quartz, containing halides.

Reflector 4 preferably has a substantially semi-elliptical shape and is provided with a first focus F1 and a second focus F2. The light source 3 is arranged at the first focus F1. Thereby, the light beam emitted by the light source 3 is concentrated in the second focus F2. In the non-limiting example described and shown herein, where reflector 4 has a semi-elliptical shape, the second focus F2 coincides with the working point PL of the light beam.

The heat-shield assembly 8 is substantially configured so as to produce a heat barrier between the area in which the light source 3 is accommodated and the area in which the first optical assembly 9, the diaphragm 10, the beam processing means 11 and the zoom assembly 12 are accommodated.

The heat-shield assembly 8 is configured to filter the hot radiations (radiations that cause an increase in the temperature of the body on which they hit) in the field of non visible radiations which come from the area in which the light source 3 is provided. Thereby, the hot radiations in the field of non visible radiations emitted by the light source 3 and by reflector 4 are prevented from hitting the light beam processing means 11, where they can generate damages due to overheating.

Diaphragm 10 is circular and is centered on the optical axis B so as to intercept the light beam.

Diaphragm 10 preferably is an iris diaphragm and defines a hole (not clearly visible in the accompanying figures) crossed, in use, by the light beam. The dimensions of the hole are variable and define the so-called "diaphragm aperture".

Figure 2:
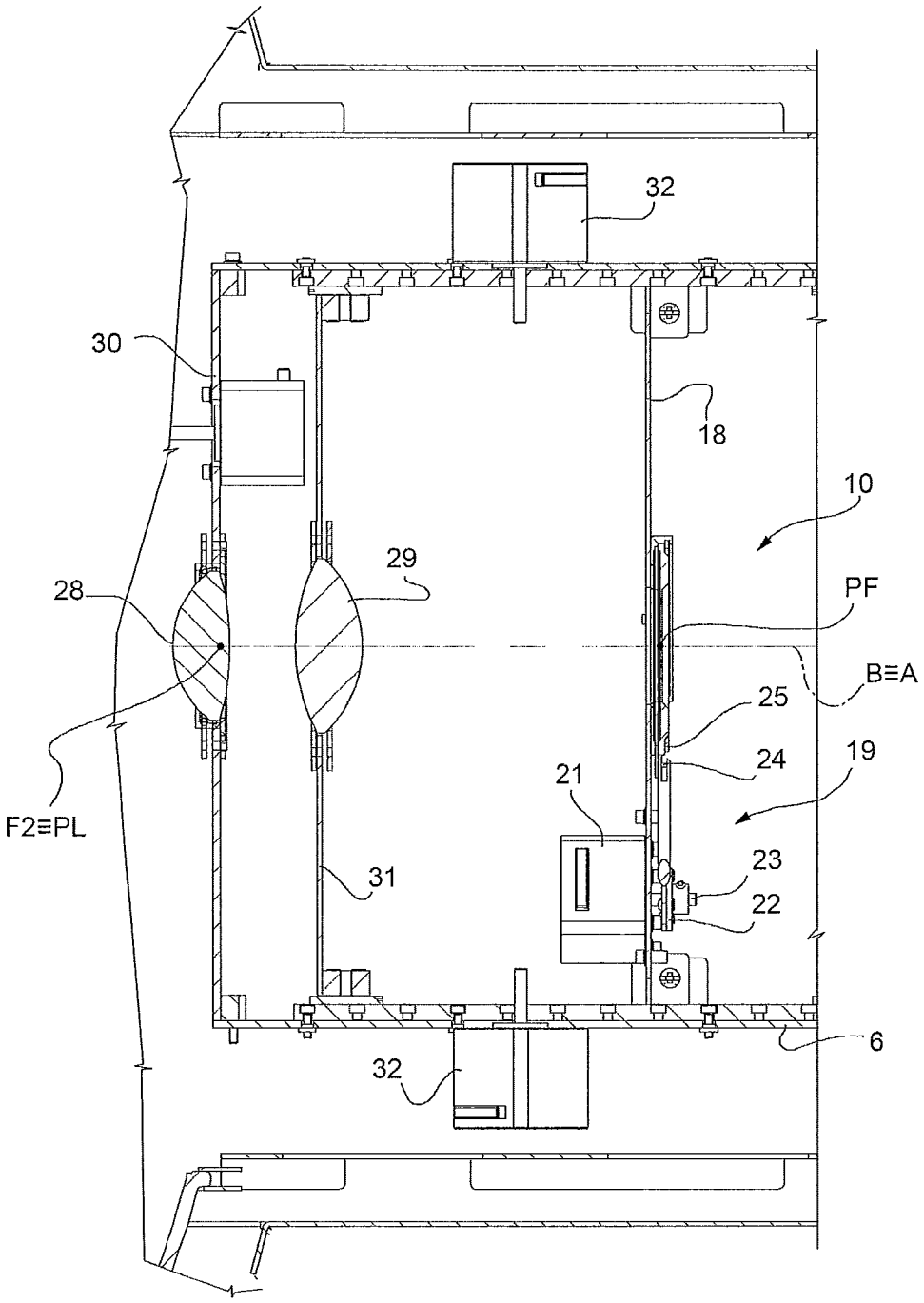
FIG. 2 shows a diagrammatic view, with parts in section and parts removed for clarity, of a detail of the stage light fixture in FIG. 1.

With reference to FIG. 2, diaphragm 10 is supported by a support plate 18 and is provided with regulating means 19 configured to regulate the aperture of diaphragm 10. In other words, the regulating means 19 regulate the diameter of the hole of diaphragm 10.

Therefore, diaphragm 10 allows the light beam to pass through the hole and stops the portion of light beam which hits the support plate 18. Therefore, the diameter of the light beam exiting from diaphragm 10 only depends on the aperture of diaphragm 10.

The regulation means 19 comprise a motor 21, preferably a stepping motor, a crank 22 mounted to a shaft 23 of motor 21, and a connecting rod 24 connected to a command 25. Command 25 regulates the position of a plurality of blades (not shown in the accompanying figures), which define the aperture of diaphragm 10.

Motor 21 is preferably controlled by the control device 14 (FIG. 1) for regulating the aperture of diaphragm 10.

A variant (not shown) provides for the support plate 18 to be mobile along the optical axis B.

The first optical assembly 9 is arranged between the light source 3 and the diaphragm 10, and is configured to process the light beam before the latter hits diaphragm 10.

In particular, the first optical assembly 9 is configured to selectively modify the dimensions of the light beam before the latter hits diaphragm 10 so as to change the concentration uniformity of the light beam projected. Thereby, the first optical assembly 9 modifies the features of the light beam which crosses the hole of diaphragm 10 according to the stage needs.

The size change of the light beam by means of the first optical assembly 9 is regulated by a command (not shown in the accompanying figures), which may be controlled either manually by an operator or automatically by the control device 14 according to the stage needs.

Preferably, the control device 14 is in communication with a remote piloting station (not shown in the accompanying figures). The communication between the control device 14 and the remote piloting station preferably occurs via DMX protocol.

For example, the level of enlargement of the first optical assembly 9 may be regulated according to the distance between the stage light fixture 1 and the object to be illuminated.

If the object to be illuminated is arranged at a distance relatively close to the stage light fixture (less than 100 meters), the first optical assembly 9 may be regulated so as to enlarge the beam to an enlargement level determined according to the stage needs. Thereby, the beam which hits diaphragm 10 is enlarged and diaphragm 10 only lets the central portion of the enlarged beam having a substantially constant luminosity through (see the luminosity curve in FIG. 3).

Due to the action of the first optical assembly 9, the variation in the luminosity between different points of the beam exiting from the diaphragm is minimum and imperceptible, and the quality of the projected beam is optimized.

The resulting light beam is characterized by high quality due to the luminosity being substantially constant and the low luminosity portion being cut by diaphragm 10.

Preferably, when the first optical assembly 9 enlarges the light beam, diaphragm 10 is in the maximum aperture position.

On the other hand, if the object to be illuminated is arranged at a distance from the stage light fixture 1 which is more than 100 meters, the first optical assembly 9 may be regulated so as to concentrate the light beam to a concentration level determined according to the stage needs.

When the beam is concentrated, the hole of diaphragm 10 is substantially crossed by the whole beam. The concentrated light beam is characterized by a highly pointed luminosity curve (see curve in FIG. 4). The luminosity of the concentrated light beam is substantially the maximum that can be obtained.

A suitable regulation of the aperture of diaphragm allows only the portion of the concentrated light beam having high luminosity through and the elimination of the peripheral portion of the light beam having low luminosity and responsible for the undesired crown which, in traditional stage light fixtures, visibly surrounds the light beam and has a lower luminosity as compared to the central beam portion.

In detail, diaphragm 10 is regulated so as to eliminate the beam portion having a luminosity inferior to a threshold value, preferably equal to about 75% of the peak luminosity value.

This generates a projection of the light beam at a high intensity and highly concentrated. Such a projection is usually identified by the technical name of "hot spot".

Figure 4:
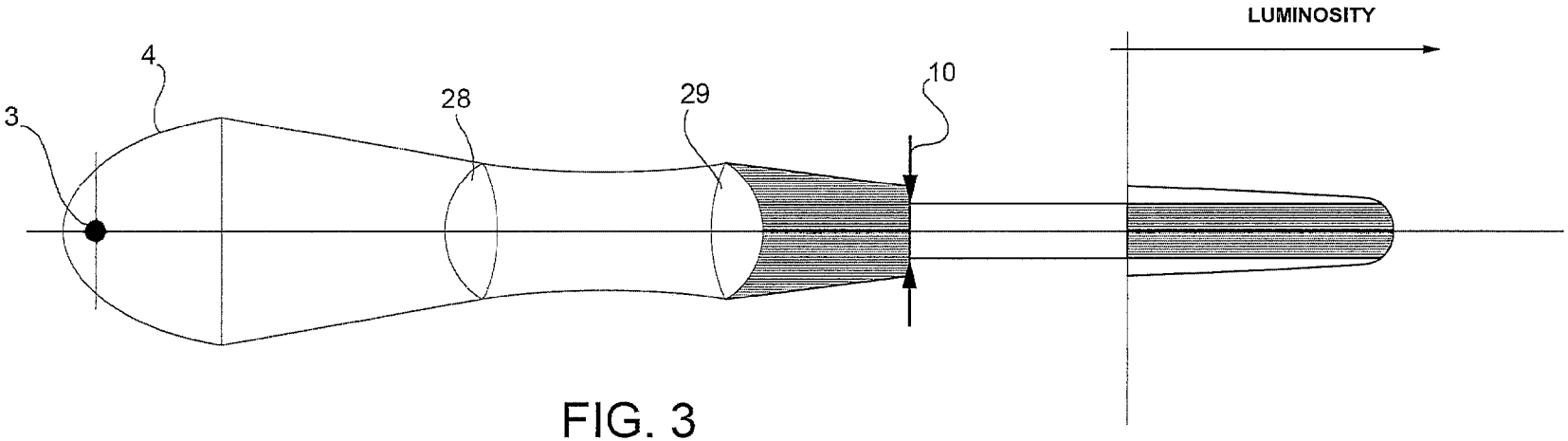
FIG. 4 shows a diagrammatic view of the detail in FIG. 2 in a second operating position, provided with a luminosity diaphragm.
Figure 3:
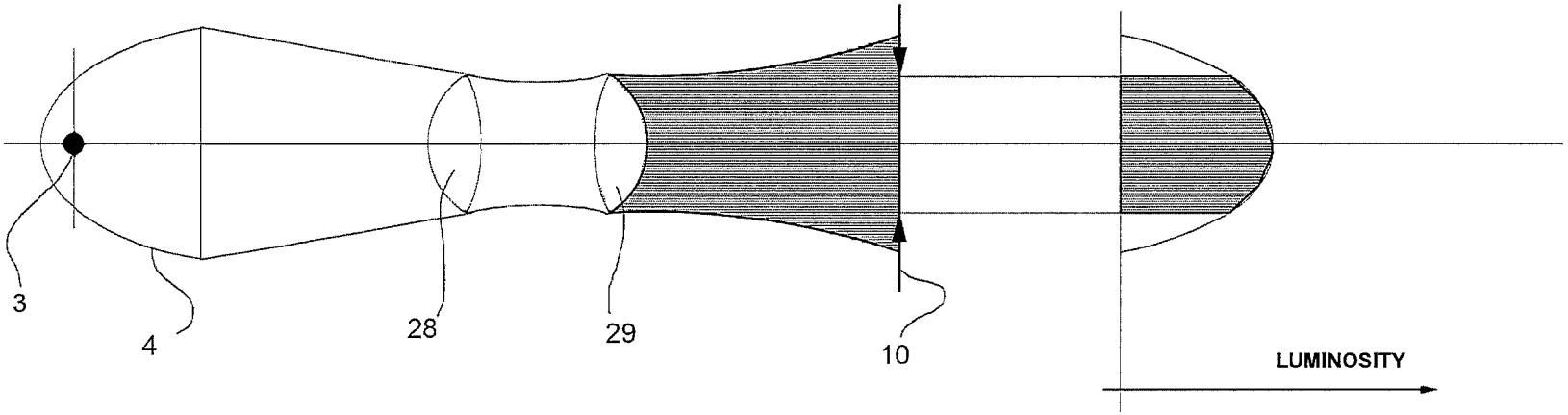
FIG. 3 shows a diagrammatic view of the detail in FIG. 2 in a first operating position, provided with a luminosity diaphragm.

In the configuration shown in FIG. 4, the stage light fixture 1 can reach a luminosity level which exceeds the luminosity level obtained in the configuration in FIG. 3 by 40%.

With reference to FIG. 2, the first optical assembly 9 substantially is a zoom assembly capable of selectively enlarging the incoming light beam. The first optical assembly 9 comprises at least one lens mobile along the optical axis B.

In particular, the first optical assembly 9 comprises a first lens 28, which is arranged near the heat-shield assembly 8 or near the light source 3, if the heat-shield assembly 8 is not provided, and a second lens 29 arranged between the first lens 28 and diaphragm 10.

The first lens 28 is preferably arranged in the above-described working point PL of the light beam. The first lens 28 is immobile and is preferably supported by a plate 30 fixed to framework 6, while the second lens 29 is preferably mobile along the optical axis B.

In particular, the second lens 29 is coupled to a carriage 31, which is mobile along the optical axis B.

In the non limiting example described herein, carriage 31 is moved by means of two electrical motors with belt transmission which are supported by framework 6.

A variant (not shown) of the present invention provides for carriage 31 to be moved by one or more worm screw electrical motors supported by carriage 31.

In the non limiting example described herein, the first lens 28 and the second lens 29 are biconvex lenses.

The size change level of the light beam which can be obtained with the first optical assembly 9 is regulated by moving the second lens 29.

In fact, lens 29 is mobile along the optical axis B between a starting position, in which lens 29 is near the first lens 28 (configurations in FIG. 2 and FIG. 3) and a final position, in which lens 29 is near diaphragm 10 (configuration in FIG. 4). In essence, the more the second lens 29 approaches the first lens 28, the higher the beam enlargement obtainable, the more the lens 29 moves away from the first lens 28, the higher the beam concentration of the light beam.

It is understood that the first optical assembly 9 may be implemented with a different number of lenses and with a different arrangement from that just described.

For example, a variant (not shown) provides for the first lens 28 to also be mobile along the optical axis B.

A second variant (not shown) provides for the first optical assembly 9 to comprise a first lens assembly and a second lens assembly. The first lens assembly comprises lenses coupled together and the second lens assembly comprises lenses together.

The first lens assembly is arranged near the light source 3, preferably at the working point PL, while the second lens assembly is arranged between the first lens assembly and diaphragm 10.

With reference to FIG. 1, the beam processing means 11 are arranged downstream of diaphragm 10 along the optical axis B.

The light beam processing means 11 are configured to modify the shape and/or color of the light beam projected by the stage light fixture 1.

In the example described herein, the light beam processing means comprise in a sequence one or more gobo assemblies configured to shape the light beam projected, a lens assembly for focusing the light beam, at least one color assembly configured to modify the color of the light beam projected, and a frost assembly configured to diffuse the incoming light beam.

The zoom assembly 12 is configured to selectively enlarge the light beam which crosses it.

In the non limiting. example described herein, the zoom assembly 12 may be a zoom assembly of the type described in application MI2009A000914 filed by the same applicant of the present application. It is understood that the zoom assembly 12 may be any zoom assembly capable of selectively enlarging the incoming light beam.

The focusing lens assembly, the zoom assembly 12 and the objective lens 5 define a second optical assembly 35, which is provided with a focal point PF.

In the non limiting example described herein, diaphragm 10 is arranged in the focal point PF of the second optical assembly 35. Thereby, the light beam crossing diaphragm 10 is focally projected.

Finally, it is apparent that changes and variations may be made to the stage light fixture described herein without departing from the scope of the appended claims.

The invention claimed is:

1. Stage light fixture (1) comprising:

a light source (3) adapted to emit a light beam along an optical axis (B);

a reflector (4) coupled to the light source (3);

a diaphragm (10) arranged along the optical axis (B) downstream of the light source (3);

a first optical assembly (9), which is arranged along the optical axis (B) between the light source (3) and the diaphragm (10) and is configured to selectively change the light beam dimensions before the light beam hits the diaphragm in order to change the amount of light passing through the diaphragm.

2. Stage light fixture according to claim 1, wherein the first optical assembly (9) comprises at least a first optical device (28) and at least a second optical device (29), which is arranged downstream of the first optical device (28).

3. Stage light fixture according to claim 2, wherein the first optical device (28) is arranged near the light source (3) and the second optical device (29) is arranged between the first optical device (28) and the diaphragm (10).

4. Stage light fixture according to claim 2, wherein the light source (3) and the reflector (4) are configured and coupled one to another so as to emit a light beam focused substantially in the environs of a working point (PL) of light beam; the first optical device (28) being arranged at said working point (PL).

5. Stage light fixture according to claim 2, wherein the first optical device (28) is immobile and the second optical device (29) is mobile in an axial direction along the optical axis (B).

6. Stage light fixture according to claim 5, wherein the second optical device (29) is mobile between a starting position wherein the second optical device (29) is arranged near the first optical device (28) and a final position wherein the second optical device (29) is arranged near the diaphragm (10).

7. Stage light fixture according to claim 2, wherein the first optical device comprises a first lens (28) biconvex.

8. Stage light fixture according to claim 2, wherein the second optical device comprises a second lens (29) biconvex.

9. Stage light fixture according to claim 1, comprising a command configured to regulate the first optical assembly (9).

10. Stage light fixture according to claim 1, comprising a second optical assembly (35), which is arranged downstream of the diaphragm (10) along the optical axis (B) and has a focal point (PF); the diaphragm (10) being arranged at the focal point (PF).

11. Stage light fixture according to claim 10, wherein the second optical assembly (35) comprises at least a focusing lens.

12. Stage light fixture according to claim 10, wherein the second optical assembly (35) comprises an objective lens (5).

13. Stage light fixture (1) comprising:

a light source (3) adapted to emit a light beam along an optical axis (B);

a reflector (4) coupled to the light source (3);

a diaphragm (10) arranged along the optical axis (B) downstream of the light source (3);

a first optical assembly (9), which is arranged along the optical axis (B) between the light source (3) and the diaphragm (10) and is configured to selectively change the light beam dimensions by either enlarging or concentrating the light beam;

a second optical assembly (35), which is arranged downstream of the diaphragm (10) along the optical axis (B) and has a focal point (PF); the diaphragm (10) being arranged at the focal point (PF), wherein the second optical assembly (35) comprises a zoom assembly (12) that is configured to selectively change the light beam dimensions by either enlarging or concentrating the light beam before the light beam hits the diaphragm in order to change at least one of the luminosity and uniformity of the light beam projected by the stage light fixture.

14. Method for operating a stage light fixture (1); the stage light fixture (1) comprising a light source (3) adapted to emit a light beam along an optical axis (B); a reflector (4) coupled to the light source (3); a diaphragm (10) arranged along the optical axis (B) downstream of the light source (3); and a first optical assembly (9), which is arranged along the optical axis (B) between the light source (3) and the diaphragm (10) and is configured to selectively change the light beam dimensions before the light beam hits the diaphragm; the method comprising the step of regulating the first optical assembly (9) so as to modify the dimensions of the light beam which hits the diaphragm (10) on the basis of the stage needs by changing the amount of light passing through the diaphragm so as to change at least one of the luminosity and uniformity of the light beam projected by the stage light fixture, while a size of the light beam projected by the stage light fixture is defined by a size of an opening of the diaphragm.

15. Method according to claim 14, further comprising a step of regulating an aperture of the diaphragm (10) so as to block passage of a portion of the light beam which hits on the diaphragm (10) and has a luminosity inferior to a predetermined threshold value.

16. Stage light fixture (1) comprising:

a light source (3) adapted to emit a light beam along an optical axis (B);

a reflector (4) coupled to the light source (3);

a diaphragm (10) arranged along the optical axis (B) downstream of the light source (3);

a first optical assembly (9), which is arranged along the optical axis (B) between the light source (3) and the diaphragm (10) and is configured to selectively change the light beam dimensions by either enlarging or concentrating the light beam before the light beam hits the diaphragm in order to change the amount of light passing through the diaphragm, while a size of the light beam projected by the stage light fixture is defined by a size of an opening of the diaphragm.

17. Stage light fixture according to claim 16, wherein the first optical assembly (9) operates a first zoom assembly and comprises at least a first optical device (28) and at least a second optical device (29), which is arranged downstream of the first optical device (28), wherein the first optical device (28) is immobile and the second optical device (29) is mobile in an axial direction along the optical axis (B) so as to either enlarge or concentrate the light beam.

18. Stage light fixture according to claim 17, comprising a second optical assembly (35), which is arranged downstream of the diaphragm (10) along the optical axis (B) and has a focal point (PF); the diaphragm (10) being arranged at the focal point (PF), wherein the second optical assembly (35) comprises a second zoom assembly (12) that is configured to selectively change the light beam dimensions by either enlarging or concentrating the light beam.

* * * * *